United States Patent [19]

Kennedy et al.

[11] Patent Number: 4,731,903

[45] Date of Patent: Mar. 22, 1988

[54] SELF-LATCHING HINGE

[75] Inventors: Robert W. Kennedy, Bridgewater; Howard J. Tyler, Marlboro, both of N.J.

[73] Assignee: White Consolidated Industries, Inc., Cleveland, Ohio

[21] Appl. No.: 923,412

[22] Filed: Oct. 27, 1986

[51] Int. Cl.[4] ..... E05D 7/00; E05D 5/00; E05F 1/08

[52] U.S. Cl. ..... 16/224; 16/257; 16/291; 16/296; 16/382; 16/DIG. 13

[58] Field of Search ..... 16/257, 259, 225, 278, 16/291, 296, 303, 321, 333, 335, 350, 380, 382, 383, 385, 374, 375, 327, DIG. 13, 224; 220/343

[56] References Cited

U.S. PATENT DOCUMENTS

| | | | |
|---|---|---|---|
| 3,262,149 | 7/1966 | Gorton et al. | 16/278 |
| 3,381,332 | 5/1968 | Jerila et al. | 16/327 |
| 3,381,333 | 5/1968 | Jerila | 16/327 |
| 3,744,887 | 7/1973 | Dunbar | 16/225 |
| 4,065,027 | 12/1977 | Ruark et al. | 220/343 |

*Primary Examiner*—Nicholas P. Godici
*Assistant Examiner*—Edward Brown
*Attorney, Agent, or Firm*—Pearne, Gordon, McCoy & Granger

[57] ABSTRACT

A hinge for mounting an access door on a room air conditioner has a hinge member having a tang at one end engaging a slot on the air conditioner front frame to mount the hinge member in a fixed position. The other end of the hinge member has a pair of resilient legs interspaced by a projection and which carry projecting trunnions on their outer ends. The door has a notch in its side having opposed side walls with bores that receive the projecting trunnions to pivot the door about the hinge member. The hinge provides a self-latching arrangement by a projecting, resilient tongue on the hinge member which engages a projecting lug on the door to resiliently bias the door to a closed position when it is within a predetermined distance from the closed position.

13 Claims, 4 Drawing Figures

SELF-LATCHING HINGE

BACKGROUND OF THE INVENTION

This invention relates generally to hinges, and more particularly to low-cost, lightweight hinges of the self-latching type. An example of the application of such a hinge is the access door or cover for a room air conditioner unit. Such a cover is used on many types of room air conditioners to cover the control panel for appearance purposes, and is easily openable to allow access to the unit controls on the control panel behind the door. Such a hinge need be of only lightweight construction, since the cover is generally formed of a plastic material as often is the front panel or frame of the air conditioner to which the cover is mounted. While such covers may be provided with a detent to hold them in the closed position, it is more desirable to be able to use a hinge of the self-latching type, which provides a biasing force tending to move the cover to a tightly closed position when it is closed to within a certain small angle of the fully closed position.

Such hinges shuld be of a low-cost construction and allow quick assembly during production, yet they should be easy to replace in the field if they should become broken.

One prior hinge arrangement for air conditioner doors is shown in U.S. Pat. No. 4,065,027, in which most of the hinge structure is formed as complementary portions on both the frame and the cover, with the rotation or pivoting action occurring about a hinge pin that is snapped in place on the cover portion and retained on the frame or panel at the upper and lower ends of the hinge pin. This construction requires complicated tooling on both the panel or frame and the door, and fails to provide the self-latching or detent feature to hold the access door in the closed position.

Hinges which provide a self-latching action are well known in a somewhat heavier duty form used for doors for kitchen cabinets and the like. Such hinges, such as shown in U.S. Pat. Nos. 3,381,332 and 3,381,333, are of more complicated and heavier duty construction required to support doors weighing several pounds each, as compared to an air conditioner access door which, typically, may weigh ony several ounces and be considerably smaller in size.

SUMMARY OF THE INVENTION

The preferred embodiment of this invention provides an improved, simple, low-cost hinge structure particularly adapted for mounting a control cover on the front panel of an air conditioner. The hinge construction requires a minimum of modification of the front panel and cover and allows rapid assembly while providing a self-latching action which will tend to hold the door or cover in the closed position with a closing biasing force that moves the door toward the fully closed position unless it is opened beyond a predetermined minimum angle, beyond which the door may be freely opened and moved pivotally through an angle of up to 180 degrees.

The hinge construction comprises a hinge member for mounting on the side of the front panel which requires alteration only in the form of a vertical slot. The hinge member has a projecting tang and shoulder which fit within the slot until the shoulder bears against the front face. The tang has a biased tab which will be deflected on insertion of the tang through the slot and then move outward to engage the rear face of the panel to prevent removal of the hinge member, which is then securely mounted on the panel.

The cover is provided with a recess on the side for each hinge. The recess has a pair of opposed side faces interconnected by a wall, and both faces extend backward perpendicular to the front face of the cover. Each of the side faces has a recess and a groove sloping toward the rear. The hinge member has a main body extending outward from the panel to terminate at the other end in a pair of flexible legs, each of which bears on its end an outwardly projecting trunnion. The cover can then be assembled on the hinge member by positioning it so that the trunnions engage the opposed grooves on the sides of the recess, and the cover is then pushed until the legs deflect and allow the trunnions to slip into the recesses, which thereby define the axis of rotation of the cover about the hinge member.

In order to provide the self-latching action, the cover has a projecting lug on the intermediate wall between the side faces extending rearwardly and outwardly toward the hinge member. The hinge member, on its intermediate portion, has a flexible tongue terminating in a projecting tip which is so positioned that when the door or cover is moved from a wide open position to a predetermined position angularly spaced from the fully closed position, the projecting tip of the tongue will engage and slide over the lug to provide an initial resistance to closing. However, after the cover is pushed a further distance toward the closed position, the tongue will ride over the lug after flexing a certain amount and, as it rides down the backside of the lug, the flexible action of the tongue provides a biasing force that then, without further effort, rotates the cover into the fully closed position against the air conditioner panel.

DESCRIPTION OF THE PREFERRED EMBODIMENT

Figure 1:
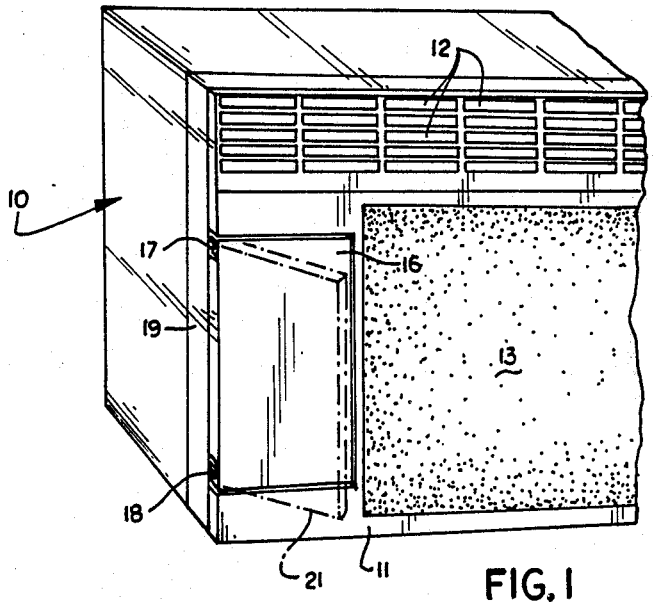
FIG. 1 is a partial, pespective view of a room air conditioner having a control panel access cover mounted on the front panel, using the preferred embodiment of the present invention.

Referring now to the drawings in greater detail, FIG. 1 shows a typical room air conditioner unit 10 having a front panel 11 attached thereto by suitable means. The front panel 11 is usually made as a unitary piece of molded plastic, and may include outlet louvers 12 across the upper portion and an inlet portion 13 through which air enters from the room that is to be cooled. The air conditioner usually has a control panel on the front at one side which, in the present example, is covered by an access cover or door 16. The door 16 is pivotally mounted by means of upper and lower hinges 17 and 18 on the side portion 19 of the front panel 11. As shown in FIG. 1, the access door 16 may be moved open to a position, as shown in phantom lines 21, to allow access to the air conditioner controls on the control panel behind the door.

Figure 2:
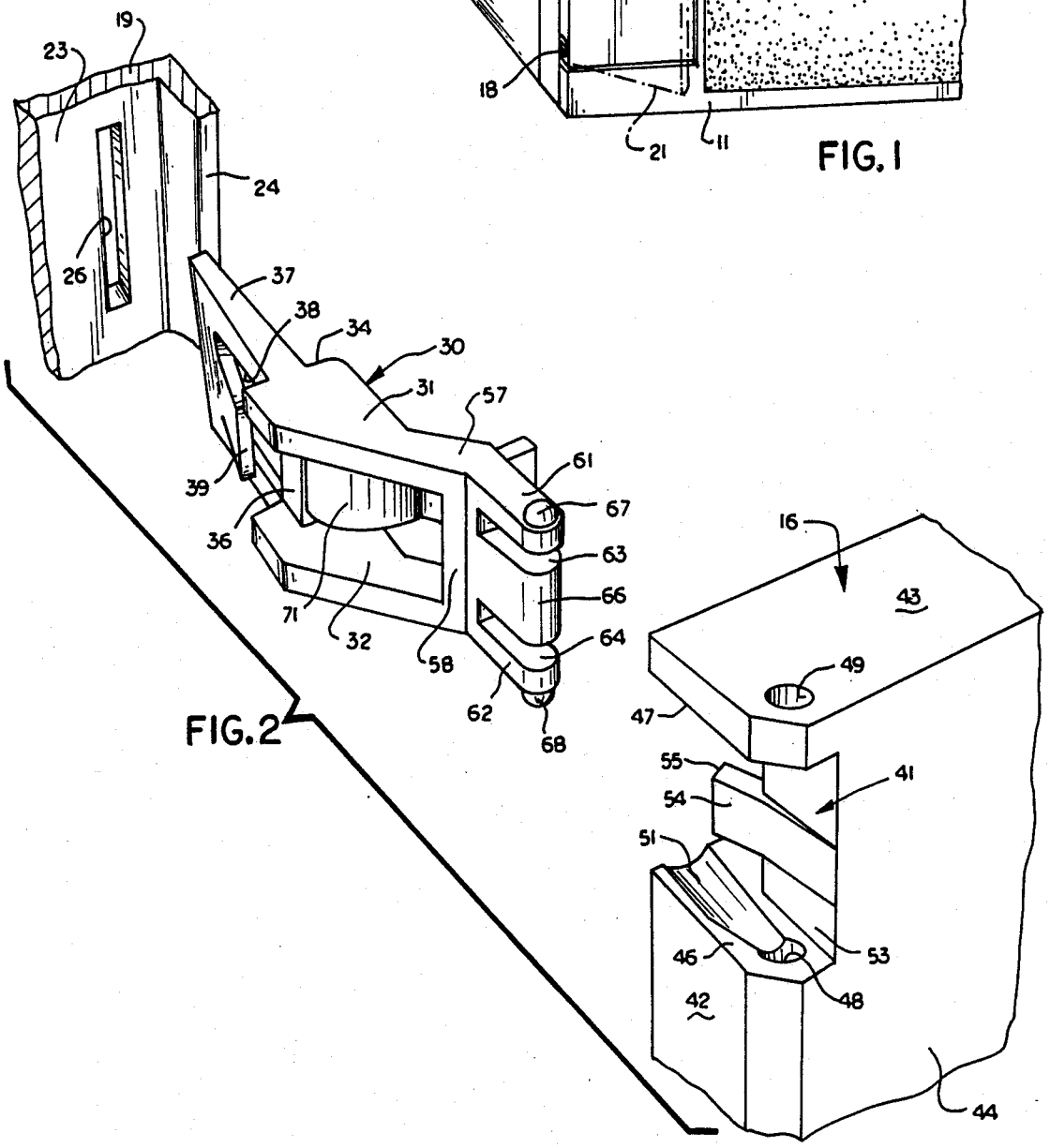
FIG. 2 is an enlarged, exploded perspective view of the hinge member and fragmentary portions of the mounting on the front panel and access cover.

The hinges 17 and 18, which are the subject of the present invention, are identical in structure, and therefore only the upper hinge 17 will be shown and described in further detail. It will be understood that the front panel 11 and access door 16, as well as the hinge member as described hereinafter below, are formed of a suitable hard, tough plastic material such as high-impact, modified polystyrene or the equivalent. As shown in FIG. 2, the front panel side 19 is formed with a flat surface 23 and an outwardly projecting ledge 24 which defines a stiffening frame around the opening for the control panel. At each hinge location, the flat surface 23 is provided with a slot 26 for mounting the hinge member 30.

The hinge member 30 is formed, preferably by molding, as a unitary piece adapted to be mounted in a fixed position on the front panel 11 and serves to provide a pivot for the access door 16. The hinge member 30 comprises a pair of generally parallel upper and lower wall portions 31 and 32, respectively. The walls 31 and 32 at one end define a shoulder 34, at which point the walls 31 and 32 are connected by a crossbar 36. A tang 37 extends beyond the shoulders 34 with a width equal to the total width of the hinge member between the outer surfaces of the walls 31 and 32. The tank 37 is dimensioned to be received within the slot 26 in a relatively tight fit to ensure that the hinge member is fixedly and securely mounted on the panel 11. To retain the hinge member in place, the tang 37 is formed with a generally U-shaped slot 38 defining a tab 39 which, in its unstressed condition, is deflected at its free end out of the plane of the tang. Thus, when the hinge member 30 is assembled onto the panel 11, the tang 37 passes through slot 26 and this causes the tab 39 to deflect back into the plane of the tang 37. The tab 39 is so dimensioned with respect to the thickness of the flat surface portion 33 that when the shoulder 34 abuts against the outer surface, the tab 39 is able to resiliently move back to its original position to abut against the rear side of the access panel 19, and thereby hold the hinge member in place. Thus, the assembly of the hinge member is accomplished by merely pushing the tang 37 into the slot 26 so that the tab can spring outward, after which assembly is complete.

In order to receive the hinge member 30, the access door 16 is provided with a hinge receiving notch 41 formed on the side wall 42, and, in the case of the upper notch, directly beneath the top wall 43 of the cover. Notch 41 has a lower side 46 extending backward from the side wall 42 and a parallel upper side 47 spaced downwardly a short distance from and parallel to the top wall 43. To pivotally receive the hinge member 30, a bore 48 is formed in the lower side 46 in axial alignment with the bore 49 at the upper side 47, which may extend through the top wall 43 to its upper surface. A groove, as shown at 51, is formed in each of the sides 46 and 47 from the rear face up to the bores 48 and 49 for easy assembly with the hinge member, as described hereinafter.

The notch 41 also has an end wall 53 extending between the upper and lower sides 46 and 47, and generally perpendicular to the front face 44 of the cover. At the midpoint of the wall 53 is an outwardly projecting lug 54 which extends toward the rear and toward the side wall 42 and terminates in a slanted end surface 55, as better shown in FIG. 3.

The hinge member walls 31 and 32 extending away from the tang 37 have an offset portion as shown at 57, where they are also connected together by another cross-bar 58. A pair of upper and lower legs 61 and 62, respectively, extend beyond the crossbar 58 and are separated by upper and lower parallel slots 63 and 64, from a central projection 66. At their ends, the legs 61 and 62 have outwardly extending trunnions 67 and 68 which fit within the bores 48 and 49 to pivotally mount the cover 16 on the hinge members. The slots 63 and 64 are positioned to give the legs 61 and 62 a certain resilience so that the cover may simply be assembled onto the hinge member by fitting the grooves 51 over the trunnions 67 and 68, and by pressing the cover toward the hinge member, the tapered grooves 51 will cause the legs 61 and 62 to deflect inwardly until the trunnions 67 and 68 can snap into the bores 48 and 49. The projection 66 between the legs 61 and 62 serves to limit their deflection inwardly to only the amount necessary to allow the trunnions to be assembled into the bores and further prevents, under conditions such as impact to the access door, any deflection of the legs to an extent that would fracture or otherwise damage the leg.

Figure 3:
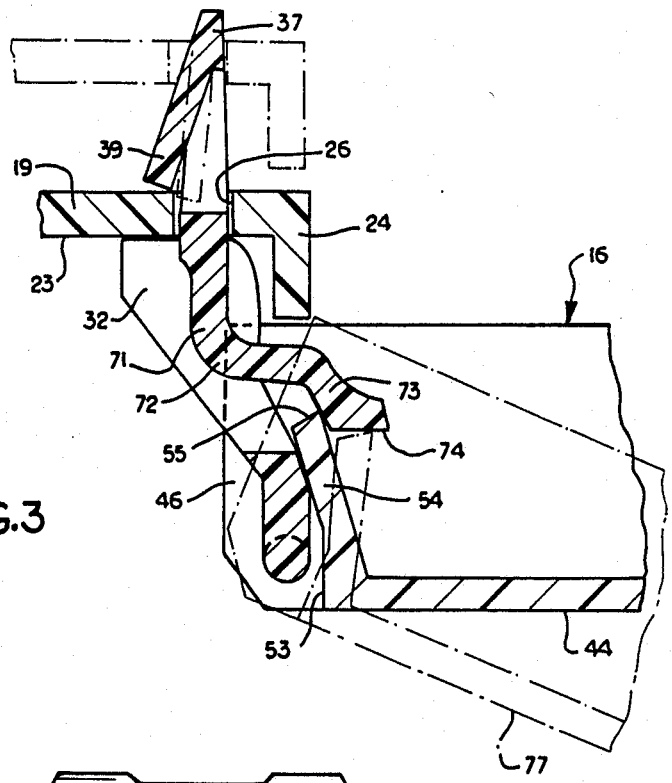
FIG. 3 is a cross-sectional view through the hinge member shown in FIG. 2, with the hinge in the fully assembled position and the cover in the closed position.
Figure 4:
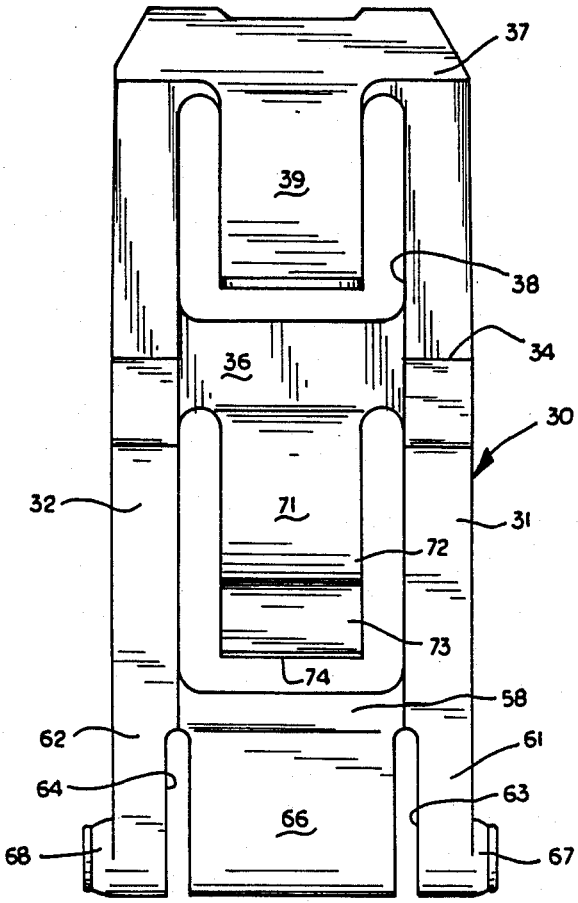
FIG. 4 is an enlarged, elevational view of the hinge member.

The self-latching feature of the hinge is provided by a resilient tongue 71 which engages the lug 54 when the door is near the closed position. Tongue 71 extends between the walls 31 and 32, and is integral with the crossbar 36. As best shown in FIG. 3, the tongue 71 extends toward the access door, and then has a bent portion 72 which is continued into a sloped portion 73 and terminates in a tip 74. The tongue 71 is thus configured to engage the end surface 55 of lip 54 as the door moves to the closed position to a point roughly shown in the phantom line 77 in FIG. 3. As the door reaches this position in a closing motion, the lug end surface 55 engages the tip 74 so that further movement of the door toward the closed position will cause the end surface 55 to deflect the tip 74 upwardly as shown in FIG. 3, until the door reaches a point closer to the closed position, where the end surface 55 moves off the tip 74 onto the sloped portion 73. At this point, the resilient deflection of the tongue 71 and the engagement between the sloped portion 73 and end surface 55 produce a biasing force moving the door to the fully closed position as the end surface 55 rides up the sloped portion 73 to the closed position as shown in solid lines in FIG. 3. Thus, while this self-latching feature of the tongue 71 and lug 54 operates to provide an initial force opposing the closing motion, further motion of the access door and the movement of the end face 55 from the tip 74 to the sloped portion 73 overcomes this biasing force and turns it into a closing biasing force, which then positively moves the door to the fully closed position.

It can be seen that the hinge structure of this invention provides a simple construction for mounting relatively lightweight doors in which most of the complex tooling for the molded part lies in the hinge member itself and requires only a slot in the panel and the configuration of the notch on the cover to provide the self-latching hinge action for the door. With this simplified construction, assembly takes a minimum amount of time, since it is only necessary on the assembly line to snap the hinge members with the tang 37 through the slot 26 to have the hinge member positively mounted on the front panel. The door is then quickly assembled by placing it near the closed position and snapping it onto the other end of the hinge member by locating the trunnions 67 and 68 in the grooves 51 and then pressing the door to the closed position so that the trunnions engage the bores 48 and 49, after which assembly is complete.

Although the preferred embodiment of this invention has been shown and described, it should be understood that various modifications and rearrangements of the parts may be resorted to without departing from the scope of the invention as disclosed and claimed herein.

What is claimed is:

1. A hinge structure for pivotally mounting a door on a frame, comprising a hinge member, means fixedly mounting one end of said hinge member on said frame, said door having a notch receiving the other end of said hinge member, said notch having a pair of sides, pivot means on said other end of said hinge member and on the sides of said notch to allow rotation of said door about an axis, one position of said door and said frame defining a closed position, and cooperating means on said hinge member and said door to provide a biasing force operable to rotate said door to the closed position.

2. A hinge structure as set forth in claim 1, wherein said pivot means comprises a pair of trunnions on said hinge member and a pair of trunnion receiving bores on said notch sides.

3. A hinge structure as set forth in claim 2, wherein each of said trunnions is mounted on a resilient leg integral with said hinge member.

4. A hinge structure as set forth in claim 1, wherein said means mounting said hinge member on said frame comprises a tang on said hinge member and a tang receiving slot on said frame.

5. A hinge structure as set forth in claim 1, wherein said cooperating means comprises a resilient tongue on said hinge member and a lug on said door engageable with said tongue.

6. A hinge structure for pivotally mounting a door on a frame, comprising a hinge member, means fixedly mounting one end of said hinge member on said frame, said door having a notch receiving the other end of said hinge member, said notch having a pair of sides and a wall extending between said sides, pivot means on said other end of said hinge member and on the sides of said notch to allow rotation of said door about an axis, one position of said door and said frame defining a closed position, a lug on said wall, and resilient tongue means on said hinge member engageable with said lug when said door is rotated to a predetermined position near said closed position to provide a biasing force operable to rotate said door to the closed position.

7. A hinge structure as set forth in claim 6, wherein said pivot means comprises a pair of trunnions on said hinge member and a pair of trunnion receiving bores on said notch sides.

8. A hinge structure as set forth in claim 7, wherein each of said trunnions is mounted on a resilient leg integral with said hinge member.

9. A hinge structure as set forth in claim 6, wherein said tongue has a configuration such that initial engagement of said tongue and said lug produces an initial force opposing movement of said door towards said closed position.

10. A hinge structure for pivotally mounting a door on a frame, comprising a hinge member, a slot on said frame, a projecting tang on one end of said hinge member engaging said slot for mounting said hinge member on said frame, said door having a notch receiving the other end of said hinge member, said notch having a pair of sides and a wall extending between said sides, a pair of parallel extending resilient legs on said other end of said hinge member, a projecting trunnion on the outer side end of each of said legs, a pair of trunnion receiving bores on the sides of said notch to allow rotation of said door about an axis between an open and a closed position with respect to said frame.

11. A hinge structure as set forth in claim 10, including a projection on said other end of said hinge member extending between said legs and operable to limit deflection of said legs toward each other.

12. A hinge structure as set forth in claim 11, including cooperating means on said hinge member and on said door operable to provide a biasing force operable to rotate said door to the closed position.

13. A hinge structure as set forth in claim 12, wherein said cooperating means includes a resilient tongue on said hinge member and a lug on said door.

* * * * *